US011357310B2

(12) United States Patent
Nestor

(10) Patent No.: US 11,357,310 B2
(45) Date of Patent: Jun. 14, 2022

(54) SINGLE-HANDED EXTENDABLE COSMETIC APPLICATOR

(71) Applicant: Joyfully You, LLC, Miami Beach, FL (US)

(72) Inventor: Marissa Joy Nestor, Miami Beach, FL (US)

(73) Assignee: JOYFULLY YOU, LLC, Miami Beach, FL (US)

( * ) Notice: Subject to any disclaimer, the term of this patent is extended or adjusted under 35 U.S.C. 154(b) by 0 days.

(21) Appl. No.: 17/285,427

(22) PCT Filed: Aug. 4, 2020

(86) PCT No.: PCT/US2020/044895
§ 371 (c)(1),
(2) Date: Apr. 14, 2021

(87) PCT Pub. No.: WO2022/031273
PCT Pub. Date: Feb. 10, 2022

(65) Prior Publication Data

US 2022/0039538 A1 Feb. 10, 2022

(51) Int. Cl.
*B43K 7/12* (2006.01)
*A45D 40/26* (2006.01)
*A45D 34/04* (2006.01)

(52) U.S. Cl.
CPC ..... *A45D 40/264* (2013.01); *A45D 34/04* (2013.01); *A45D 34/043* (2013.01); *A45D 34/045* (2013.01); *A45D 2200/25* (2013.01)

(58) Field of Classification Search
CPC ..... A46B 2200/1053; A45D 34/04; A45D 34/043; A45D 34/045; A45D 40/264
See application file for complete search history.

(56) References Cited

U.S. PATENT DOCUMENTS 6,412,999 B1 7/2002 Pierpont
7,237,973 B1 * 7/2007 Lou ..... A45D 40/264 132/218
7,228,864 B2 12/2007 Tahara
8,215,858 B2 * 7/2012 Carroll ..... A45D 34/043 401/115
8,292,529 B2 * 10/2012 Francavilla ..... A45D 34/043 401/101
8,393,814 B2 3/2013 Challman et al.
2018/0055194 A1 1/2018 Arredondo

FOREIGN PATENT DOCUMENTS

WO 2009031851 A2 3/2009

* cited by examiner

*Primary Examiner* — Jennifer C Chiang

(74) *Attorney, Agent, or Firm* — Mark C. Johnson; Johnson Dalal

(57) ABSTRACT

A single-handed extendable cosmetic applicator having an applicator body with a first, second, and third body shell portion and a selectively removable cover disposed at a second end of the applicator body that is operably configured to dispose an opening. The applicator body encapsulates a cosmetic applicator stem with an applicator surface. When the applicator is desired to be used, the user may rotate the second body shell portion with respect to the first body shell portion to cause the applicator surface to extend and retract through the opening with a single hand of a user. In some embodiments, the third shell portion may be selectively removable and include different cosmetic products for desired use by the user.

17 Claims, 10 Drawing Sheets

SINGLE-HANDED EXTENDABLE COSMETIC APPLICATOR

FIELD OF THE INVENTION

The present invention relates generally to cosmetic applicators and, more particularly, relates to cosmetic applicators operably configured to be selectively extended and retracted.

BACKGROUND OF THE INVENTION

A large number of the earth's population utilize cosmetics to care for the face and/or body of a user and/or to enhance or change the appearance of a user's face and/or body. Typically, cosmetic products include skin care, personal care, cosmetics, and fragrance. There is a vast array of cosmetics available, ranging from shampoo to moisturizer to lipstick. Each sub-category of cosmetics has its own characteristics; however, the products are generally formulated using a mixture of chemical compounds derived from natural sources or created synthetically. Cosmetics are typically known to have three purposes, i.e., to cleanse, to replenish and protect the skin, or to enhance a user's appearance. Some of these cosmetic materials include, but are not limited to, lipstick, lip liner, mascara, eye shadow, foundation, blush, highlighter, bronzer, and several others.

Whether it is due to a user's physical limitations or user convenience, many users find it difficult, inconvenient, inefficient, and sometimes, unsafe, to apply a cosmetic material to a user's face and/or body with only one hand of a user.

Therefore, a need exists to overcome the problems with the prior art as discussed above.

SUMMARY OF THE INVENTION

The invention provides a single-handed extendable cosmetic applicator that overcomes the hereinafore-mentioned disadvantages of the heretofore-known devices and methods of this general type and that can be selectively and manually operated with a single hand of a user. The device also enables the user to reuse the device with multiple different types of cosmetics, e.g., mascara, lip liner, lip gloss, etc.

With the foregoing and other objects in view, there is provided, in accordance with the invention, a single-handed extendable cosmetic applicator that includes an applicator body. The body may include a selectively removable cover disposed at a second end, defining a second opening, of the applicator body that opposes a first end of the applicator body, a first body shell portion having a sidewall surrounding and defining, with an inner surface of the first body shell portion, a first body shell cavity, and a second body shell portion rotatably coupled to the first body shell portion and having a first end, a second end opposing the first end of the second body shell portion, and a sidewall with a first portion disposed within the first shell cavity and a second portion having an outer surface and an inner surface opposing the outer surface of the second body shell portion and defining a second portion cavity, wherein the second body shell portion defines an enclosed aperture spatially coupling the enclosed aperture to the first body shell cavity. The assembly also includes a cosmetic applicator stem having a lower end disposed in the first body shell cavity, an upper end opposing the lower end of the applicator stem, with a portion spanning through the enclosed aperture defined by the second body shell portion, with another portion coupled to the second body shell portion, and an applicator surface defined by a distal end of a plurality of bristles radially extending outwardly from an outer surface of the applicator stem, the second body shell portion operably configured to rotate about a longitudinal axis along a rotation path to cause linear and longitudinal translation of the cosmetic applicator stem through the second opening.

In accordance with another feature, an embodiment of the present invention includes the applicator body also includes a third body shell portion that has a sidewall surrounding and defining, with an inner surface of the third body shell portion, a third body shell cavity housing a liquid substance therein. The third body shell portion also includes a bottom surface defining an enclosed aperture and a first end and a second end opposing the first end of the third body shell portion, wherein the first end of the third body shell portion is selectively removably coupled to the second end of the second body shell portion with a tongue-and-groove configuration.

In accordance with yet another feature, an embodiment of the present invention also includes the third body shell portion having a plug operably configured to be selectively removably couplable to the first end of the third body shell portion in a watertight configuration and with a portion shaped and sized to be inserted within the enclosed aperture of the third body shell portion.

In accordance with a further feature of the present invention, the second opening defined by the second end of the applicator body, the enclosed aperture defined by the bottom surface of the third body shell portion, and the enclosed aperture defined by the second body shell portion are axially aligned with one another about the longitudinal axis.

In accordance with yet another feature, an embodiment of the present invention also includes the third body shell portion 116 having a cap operably configured to be selectively removably couplable to the second end of the third body shell portion in a watertight configuration and with a portion shaped and sized to be inserted within an enclosed aperture defined by the second end of the third body shell portion, wherein the cap has the cover selectively removably coupled thereto.

In accordance with an additional feature, an embodiment of the present invention also includes the third body shell portion having an internal sidewall surface disposed proximal to the second end of the third body shell portion and with a portion enclosing and tapering in diameter centrally to define an enclosed internal stem aperture of a stem aperture diameter greater in length than a stem diameter defined by a portion of the applicator stem and less than an applicator diameter defined by two opposing applicator surfaces.

In accordance with another feature of the present invention, the applicator surface is selectively removably coupled and locked to the cosmetic applicator stem. Additionally, the applicator surface may circumferentially span around at least 50% a perimeter of the outer surface of the applicator stem.

In accordance with another feature, an embodiment of the present invention also includes the outer surface of the second body shell portion having a plurality of raised surfaces spanning longitudinally thereon and each respectively defining a recess therein between.

In accordance with another feature, an embodiment of the present invention also includes a double-helix shaped channel defined by the sidewall of the first body shell portion and spanning in a longitudinal direction, two stem translation channels defined by the first portion of the sidewall disposed within the first shell cavity, and two applicator guide members projecting radially from the cosmetic applicator stem at least partially disposed, respectively, within the two stem translation channels and the double-helix shaped channel. The rotation path of one of the body shell members are operably configured to cause rotation of the cosmetic applicator stem through the second opening the rotation of the two applicator guide members around the double-helix shaped channel.

In accordance with yet another feature of the present invention, the two applicator guide members oppose one another, and the two stem translation channels oppose one another as well. The two stem translation channels may have a linear and longitudinal oriented section flanked by and spatially coupled to two linear and transverse oriented sections.

Also in accordance with the present invention, a single-handed extendable cosmetic applicator an applicator body is disclosed that includes a selectively removable cover disposed at a second end, defining a second opening, of the applicator body that opposes a first end of the applicator body. The applicator body includes a first body shell portion having a sidewall surrounding and defining, with an inner surface of the first body shell portion, a first body shell cavity, and a second body shell portion rotatably coupled to the first body shell portion and having a first end, a second end opposing the first end of the second body shell portion, and a sidewall with a first portion disposed within the first shell cavity and a second portion having an outer surface and an inner surface opposing the outer surface of the second body shell portion and defining a second portion cavity. The second body shell portion may define an enclosed aperture spatially coupling the enclosed aperture to the first body shell cavity. The assembly also includes a third body shell portion having a sidewall surrounding and defining, with an inner surface of the third body shell portion, a third body shell cavity housing a liquid substance therein. Further, the third body shell portion includes a bottom surface defining an enclosed aperture and a first end and a second end opposing the first end of the third body shell portion, wherein the first end of the third body shell portion is selectively removably coupled to the second end of the second body shell portion with a tongue-and-groove configuration. The assembly also includes a cosmetic applicator stem having a lower end disposed in the first body shell cavity, an upper end opposing the lower end of the applicator stem, with a portion spanning through the enclosed aperture defined by the second body shell portion, with another portion coupled to the second body shell portion, and an applicator surface defined by the applicator stem. The second body shell portion is operably configured to rotate about a longitudinal axis along a rotation path to cause linear and longitudinal translation of the cosmetic applicator stem through the second opening.

Although the invention is illustrated and described herein as embodied in a single-handed extendable cosmetic applicator, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the applicator body from the bottom end to the top end of the applicator body.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
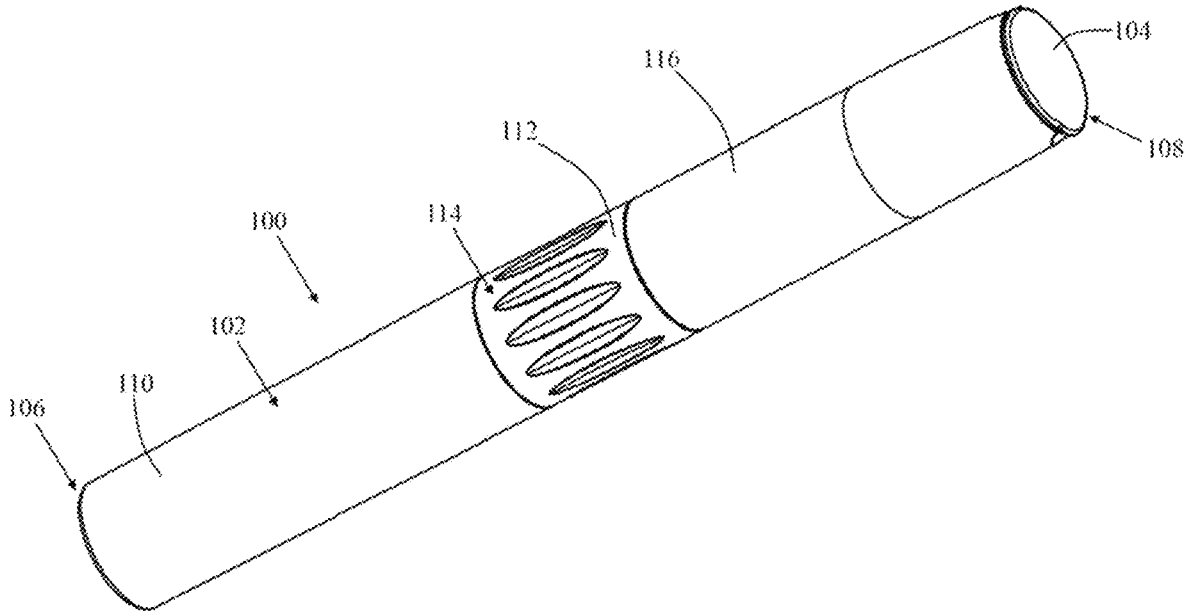
FIG. 1 is a perspective view of a single-handed extendable cosmetic applicator in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient single-handed extendable cosmetic applicator designed to advantageously, conveniently, safely, and effectively extend and retract an applicator stem, having an applicator surface, with a single hand of a user. Embodiments of the invention also provide users the ability replace or exchange the cosmetic liquid contents in the applicator in an efficient and effective manner.

Referring now to FIGS. 1-2 and FIGS. 5-7, one embodiment of the present invention is shown. Said figures and others herein show several advantageous features of the present invention, but, as will be described below, the invention can be provided in several shapes, sizes, combinations of features and components, and varying numbers and functions of the components. The first example of a single-handed extendable cosmetic applicator 100, as shown in figures, includes an applicator body 102 and a cosmetic applicator stem 700 that is operably configured to extend and retract from the applicator body 102 for use by the user. Although the applicator 100 is beneficially configured for use with a single hand of a user, the applicator 100 may also be operable with two hands of a user and is otherwise not limited as such unless explicitly provided for in the body of the claims.

More specifically, the applicator body 102 may include a first body shell portion 110, a second body shell portion 114, and a third body shell portion 116 that enable grasping by the user, in addition to safe and efficient for storage, transportation, and use. The applicator body 102 may also include a selectively removable cover 104 disposed at a second end 108 of the applicator body 102, wherein the cover 104 may be operably configured to be removed (either completely or partially, and rotatably and/or linearly) from the second end 108 to expose a second opening 204 defined by the applicator body 102, e.g., a part of the third body shell portion 116. The second end 108 opposes a first end 106 of the applicator body 102 to define an applicator length separating the first and second ends 106, 108 of the applicator body 102. To enable the most effectively handling, the applicator length may be approximately 4-6 inches and may weigh approximately 0.1-0.75 lbs. Other lengths and weights may be contemplated, however, depending on material specifications and design constraints.

The first body shell portion 110 includes a sidewall 500 surrounding and defining, with an inner surface 504 of the first body shell portion 110, a first body shell cavity 502. As used herein, the term "wall" is intended broadly to encompass continuous structures, as well as, separate structures that are coupled together so as to form a substantially continuous external surface. The second body shell portion 112 may then be rotatably coupled to the first body shell portion 110 using a tongue-and-groove configuration, e.g., snap-fit. In some embodiments of the present invention, the second body shell portion 112 is also operably configured to be locked longitudinally with respect to the first body shell portion 110. The second body shell portion 112 also has a first end 612, a second end 614 opposing the first end 612 of the second body shell portion 112, and a sidewall 600 with a first portion 602 disposed within the first shell cavity 502. The sidewall 600 also includes a second portion 604 having an outer surface 114 and an inner surface 606. The inner surface 606 opposes the outer surface 114 of the second body shell portion 112 and defines a second portion cavity 608. As seen in the figures, the shell portion 112 may have a diameter separating two opposing outer surfaces that is greater than a diameter separating two opposing outer surfaces on the shell portion 110. The second body shell portion 112 may define (at least partially) an enclosed aperture 610 spatially coupling the enclosed aperture 610 to the first body shell cavity 502, wherein the enclosed aperture 610 serves as space for entry and egress of the cosmetic stem 700.

Figure 4:
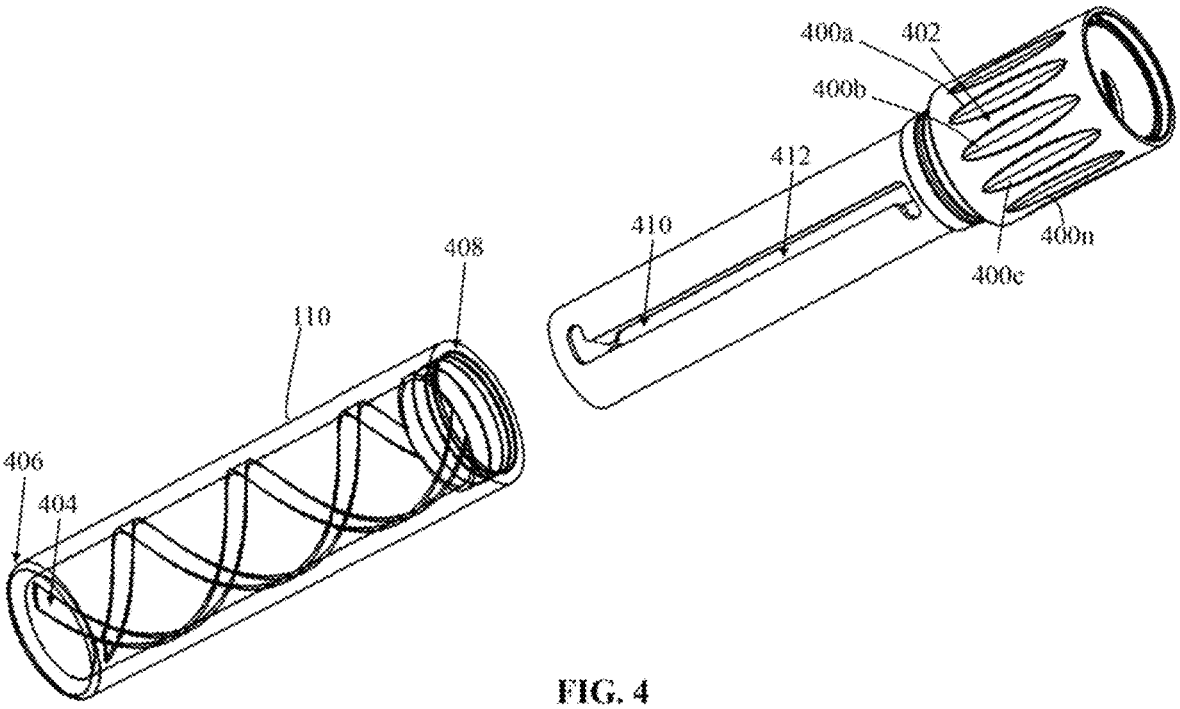
FIG. 4 is an exploded and partially transparent view of a first and second body shell portion of the cosmetic applicator in FIG. 1 in accordance with one embodiment of the present invention.
Figure 5:
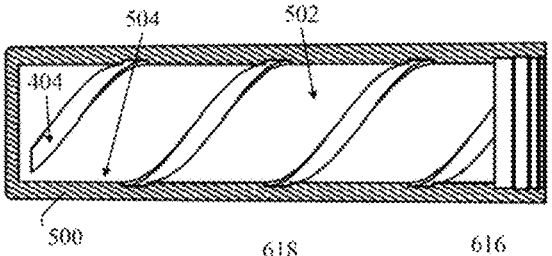
FIG. 5 is a cross-sectional view of a first body shell portion of the cosmetic applicator in FIG. 1 in accordance with one embodiment of the present invention.

With reference to FIG. 1 and FIG. 4, the outer surface 114 of the second body shell portion 112 may also beneficially include a plurality of raised surfaces 400*a-n* thereon to enable effective and safe rotation of the second body shell portion 112 with respect to the first body shell portion 110. To facilitate in single-hand rotation, the plurality of raised surfaces 400*a-n* may span longitudinally on the outer surface 114 and may each respectively define a recess 402 therein between. In one embodiment, the raised surfaces may be approximately 0.025-0.1 offset from the outer surface 114.

With reference to FIG. 1 and FIGS. 5-7, the cosmetic applicator stem 700 may have a lower end 702 disposed in the first body shell cavity 502, an upper end 704 opposing the lower end 702 of the applicator stem 700, and a portion 1000 spanning through the enclosed aperture 610 defined by the second body shell portion 112. The cosmetic applicator stem 700 includes another portion 1002 that may be coupled to the second body shell portion 112, e.g., through one or more applicator guide member(s) 716, 718 that may be coupled to the stem 700 or a coupler 720 that may selectively removably (and potentially, frictionally) coupled to the stem 700. The applicator guide member(s) 716, 718 beneficially project radially from the cosmetic applicator stem 700 and may be disposed on opposing sides of the applicator stem 700 and/or the coupler 720. The cosmetical applicator stem 700 may be of a substantially rigid, yet flexible, material that enable minimal flexion when subjected to forces of approximately 1-2 lbs. In one embodiment, the stem (and the components coupled directly thereto) may be of a polymeric material such as polyoxymethylene (POM). In other embodiments, the material may vary.

Figure 8:
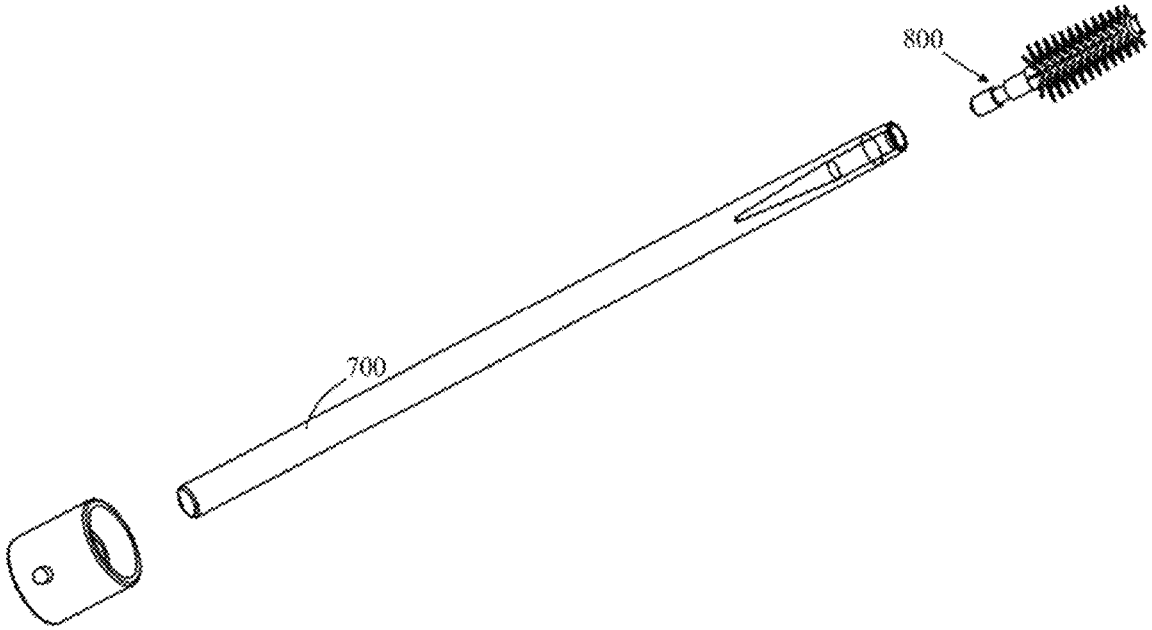
FIG. 8 is an exploded view of the cosmetic applicator stem in accordance with one embodiment of the present invention.
Figure 14:
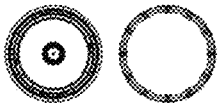
FIG. 14 is a top and bottom plan view of first and second body shell portions and a cosmetic applicator stem in accordance with one embodiment of the present invention.
Figure 15:
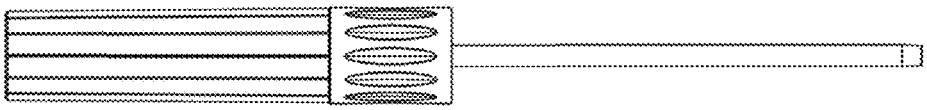
FIG. 15 is an elevational side view of the first and second body shell portions and the cosmetic applicator stem in FIG. 14 in accordance with one embodiment of the present invention.
Figure 16:
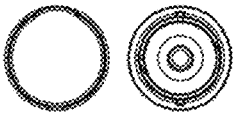
FIG. 16 is a top and bottom plan view of a third body shell portion in accordance with one embodiment of the present invention.
Figure 17:
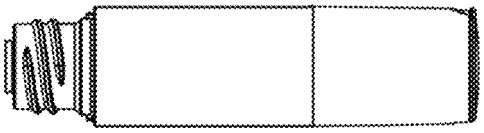
FIG. 17 is an elevational side view of the third body shell portion in FIG. 16 in accordance with one embodiment of the present invention.
Figure 18:
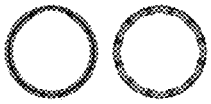
FIG. 18 is a top and bottom top plan view of the cosmetic applicator in FIG. 1 in accordance with one embodiment of the present invention.
Figure 19:
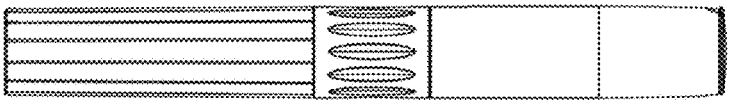
FIG. 19 is an elevational side view of the cosmetic applicator in FIG. 1 in accordance with one embodiment of the present invention.

The cosmetic applicator stem 700 beneficially includes an applicator surface 706 defined by a distal end of a plurality of bristles 708*a-n* radially extending outwardly from an outer surface 710 of the applicator stem 700. In other embodiments, the applicator surface 706 may be formed from another surface or surface(s), e.g., a sponge material or a cosmetic material. The plurality of bristles 708*a-n* may be of a polymeric and flexible material, e.g., nylon, rayon, silicon, plastic, and rubber. In preferred embodiments, the applicator surface 706 circumferentially spans around at least 50%, e.g., 100% (as shown best in FIG. 14), a perimeter of the outer surface 710 of the applicator stem 700 to provide effective application of the cosmetic liquid or material to the user regardless the orientation of the applicator surface 706. Because the applicator 100 may be operable for utilization with different cosmetic materials, the applicator surface 706 may be selectively removably coupled and locked to the cosmetic applicator stem 700 using, for example, a tongue-and-groove configuration 800 (as shown best in FIG. 8).

Figure 9:
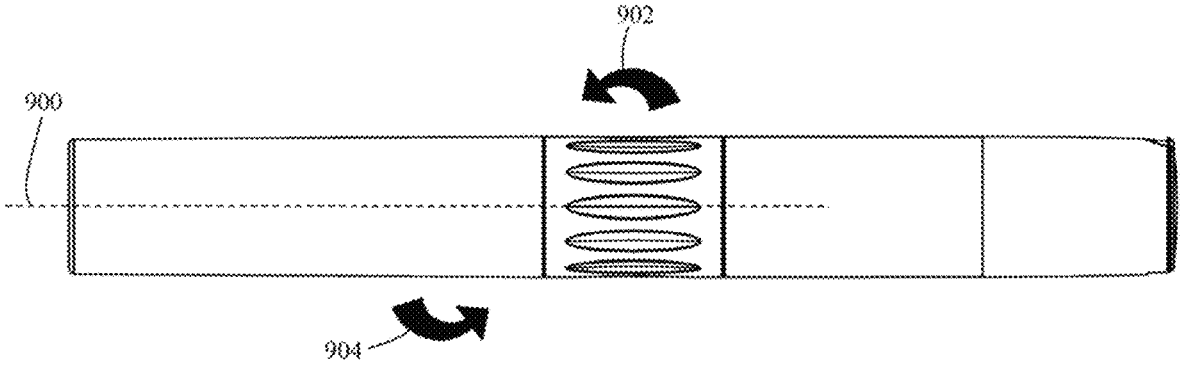
FIG. 9 is an elevational side view of the cosmetic applicator in FIG. 1 with an indication of rotation in accordance with one embodiment of the present invention.
Figure 10:
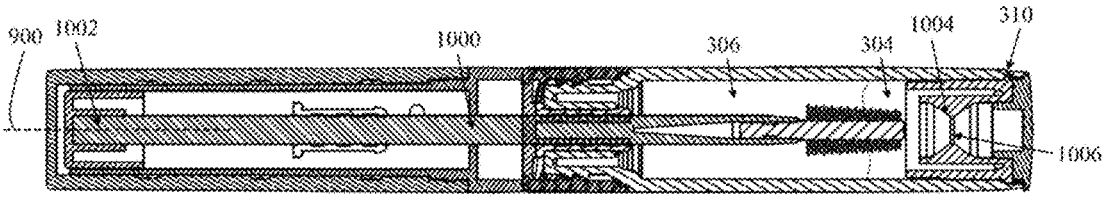
FIG. 10 is a cross-sectional view of the cosmetic applicator in FIG. 1 with the cosmetic applicator stem housed therein in accordance with one embodiment of the present invention.
Figure 11:
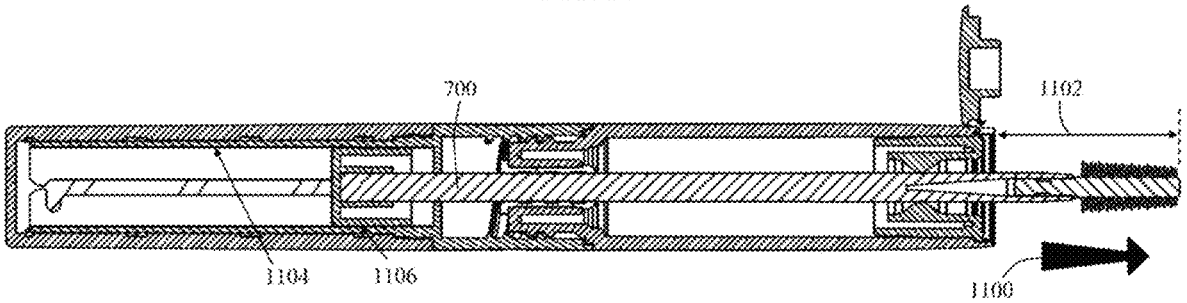
FIG. 11 is a cross-sectional view of the cosmetic applicator in FIG. 1 with the cosmetic applicator stem projecting outwardly from an upper end of the cosmetic applicator in accordance with one embodiment of the present invention.

With reference to FIGS. 9-11, the second body shell portion 112 is operably configured to rotate about a longitudinal axis 900 along a rotation path (exemplified with arrows 902, 904) to cause linear and longitudinal translation (the direction of which is exemplified with arrow 1100) of the cosmetic applicator stem 700 through the second opening 200. Said differently, to enable linear translation of the cosmetic applicator stem 700 the second body shell portion 112 may be rotated in a clockwise or counterclockwise direction, thereby causing the applicator stem 700 to be moved in various linear positions. As such, the user is only required to keep his or her hand in one location on the applicator 100 and cause translation of the cosmetic applicator stem 700, e.g., with a user's fingers. Some of the linear positions of the applicator stem 700 may include a storage position (shown best in FIG. 10) with the applicator surface 706 housed or encapsulated within the applicator 100, e.g., within a third body shell cavity 304 defined by the sidewall 300 that surrounds, with an inner surface 302 thereon, the third body shell cavity 304.

Figure 12:
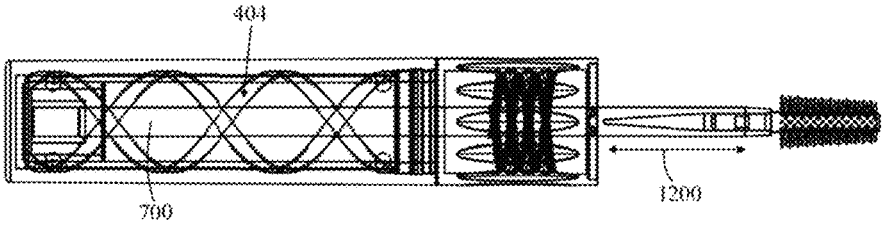
FIG. 12 is an elevational partially transparent view of the first and second body shell portions of the cosmetic applicator in FIG. 1 with the cosmetic applicator stem in a recessed position in accordance with one embodiment of the present invention.
Figure 13:
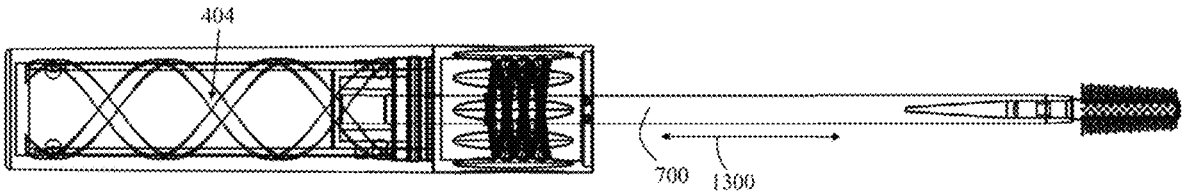
FIG. 13 is an elevational partially transparent view of the first and second body shell portions of the cosmetic applicator in FIG. 1 with the cosmetic applicator stem in a projected position in accordance with one embodiment of the present invention.

With reference to FIGS. 4-7 and FIG. 9, in one embodiment, the container 100 includes a double-helix shaped channel 404 defined by the sidewall 500 of the first body shell portion 110 and which spans in the longitudinal direction of the container 100. The first portion 602 of the sidewall 600 may also define two stem translation channels 410, 412 that are disposed within the first shell cavity 502, wherein the two applicator guide members 716, 718 that project radially from the cosmetic applicator stem 700 are at least partially disposed, respectively, within the two stem translation channels 410, 412 and the double-helix shaped channel 404. As such, the rotation path (exemplified with arrows 902, 904) is operably configured to cause rotation of the cosmetic applicator stem 700 through the second opening 200 the rotation of the two applicator guide members 716, 718 around the double-helix shaped channel 404. The movement of the applicator stem 700 linearly (represented with arrows 1200, 1300) using said double-helix shaped channel 404 can also be seen in FIGS. 12-13. In one embodiment, the two applicator guide members 716, 718 oppose one another. Said another way, the two applicator guide members 716, 718 may be oriented and configured approximately 180° with respect to one another. The two stem translation channels 410, 412 may also oppose one another and have a linear and longitudinal oriented section 616 flanked by and spatially coupled to two linear and transverse oriented sections 618, 620. As such, the two applicator guide members 716, 718 are prevented from extending a particular length (depicted in FIG. 11 with arrow 1102) passed the second end 108 of the applicator body 102.

In another embodiment, the cosmetic applicator stem 700 may be translated and extended or retracted from the applicator body 102 with a threaded coupling configuration. More specifically, and using structural components of the cosmetic device 100 depicted in FIG. 11, the inner surface 1104 of the second body shell 112 may define a threaded configuration that is complementary to a threaded configuration defined by a portion of an outer surface 1106 of the cosmetic stem 700. The cosmetic stem 700 may be longitudinally and/or rotational biased and/or partially restricted, e.g., using a spring, to facilitate in moving the cosmetic stem 700 linearly caused by rotation of the second body shell 112.

Figure 2:
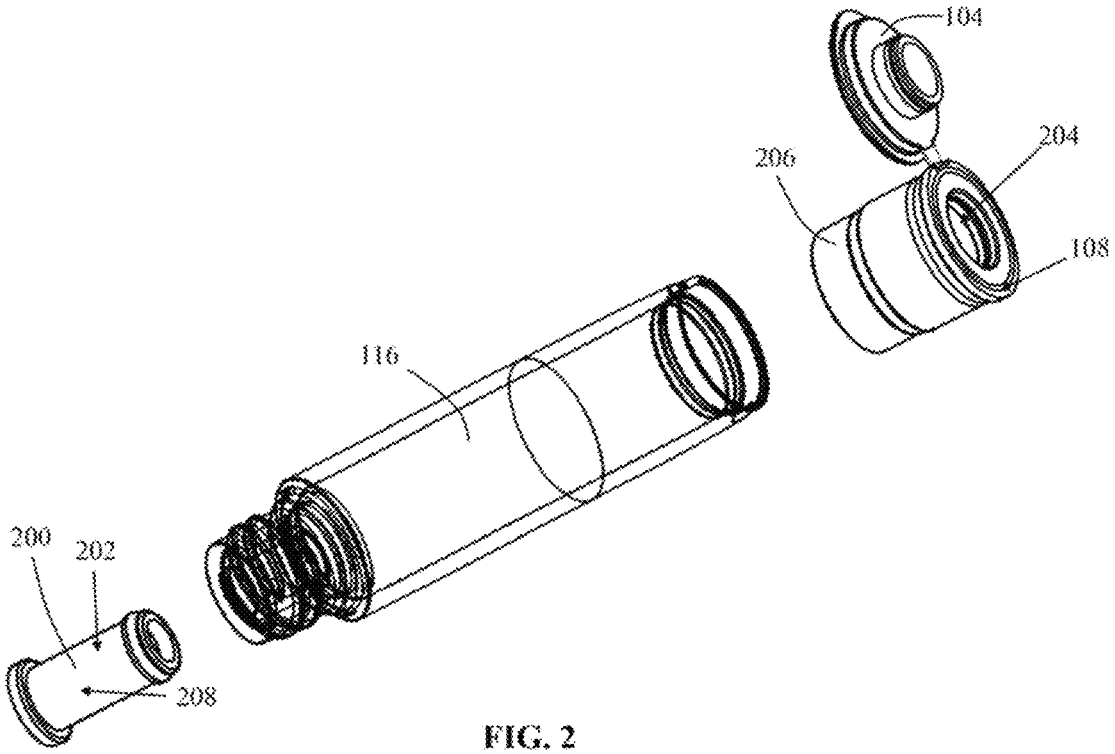
FIG. 2 is an exploded and partially transparent view of a third body shell portion of the cosmetic applicator in FIG. 1 with a cover open in accordance with one embodiment of the present invention.
Figure 3:
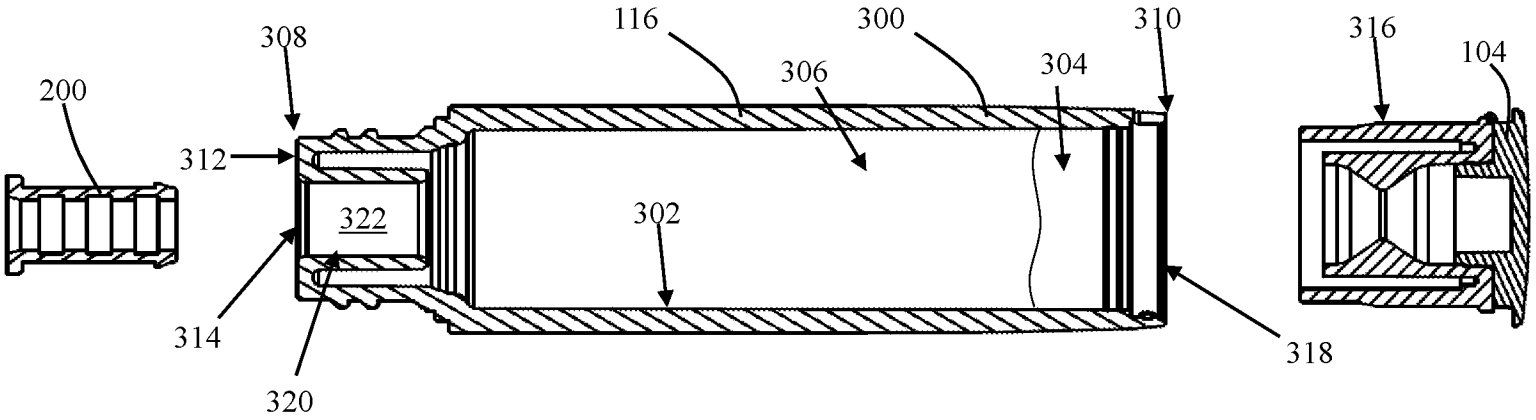
FIG. 3 is a cross-sectional view of a third body shell portion of the cosmetic applicator in FIG. 1 in accordance with one embodiment of the present invention.

Now with reference to FIGS. 2-3, the third body shell cavity 304 can be seen beneficially housing a liquid substance 306, e.g., mascara, therein for applying to, and/or absorbing with, the applicator surface 706. Specifically, the third body shell portion 116 has a sidewall 300 surrounding and defining, with an inner surface 302 of the third body shell portion 116. In one embodiment, the third body shell cavity 304 may house approximately 3-5 ml of a liquid substance therein. In other embodiments, another volume may be utilized. The third body shell portion 116 also includes a bottom surface 312 defining an enclosed aperture 314, a first end 308, and a second end 310 opposing the first end 308 of the third body shell portion 116. As best seen in FIGS. 10-11, the first end 308 of the third body shell portion 116 is selectively removably couplable to the second end 614 of the second body shell portion 112 with a tongue-and-groove configuration, e.g., a threaded configuration.

As the third body shell portion 116 may be selectively removable and replaceable with another cosmetic substance, the third body shell portion 116 beneficially includes a plug 200 operably configured to be selectively removably couplable to the first end 308 of the third body shell portion 116 in a watertight configuration. The plug 200 includes a portion 202 shaped and sized to be inserted within the enclosed aperture 314 of the third body shell portion 116. The plug 200 may be frictionally couplable to the third body shell portion 116, thereby causing the watertight configuration through compression of an outer surface 208 of the plug 200 with an inner surface 320 of the third body shell portion 116 that defines the plug entrance channel 322. In another embodiment, the plug 200 may include flanges disposed at the distal end of the plug 200 and the plug may be of a deformable polymeric material, e.g., nitrile rubber. When desired for replacement, the user will remove a third body shell portion 116 from the applicator 102, remove the plug 200 from a replacement third body shell portion housing a cosmetic substance, and then may couple the replacement third body shell portion to the second body shell 112 in a locked and watertight configuration, i.e., the replacement third body shell portion may not be freely removable from the second body shell 112. In some embodiments, the connection between the body shell portions 110, 112, 116 may include one or more gaskets facilitating the watertight connection.

Figure 6:
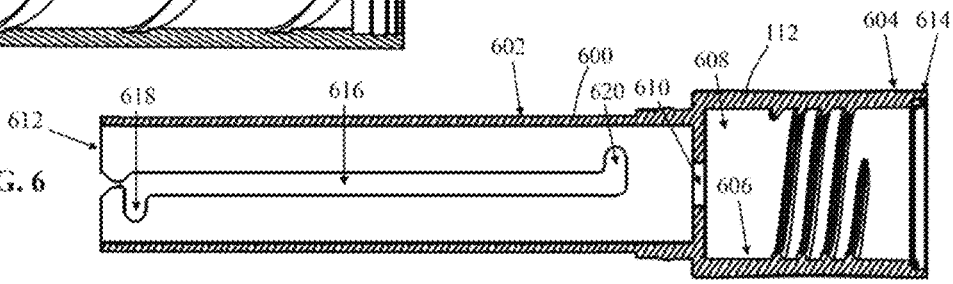
FIG. 6 is a cross-sectional view of a second body shell portion of the cosmetic applicator in FIG. 1 in accordance with one embodiment of the present invention.
Figure 7:
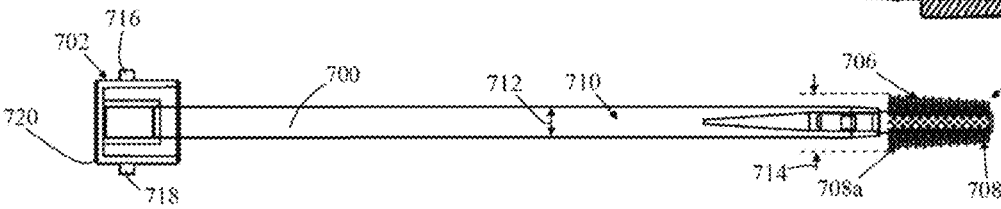
FIG. 7 is an elevational side view of a cosmetic applicator stem of the cosmetic applicator in accordance with one embodiment of the present invention.

Referring to FIGS. 2-3 in combination with FIGS. 6-7 and FIG. 9, the second opening 204 defined by the second end 108 of the applicator body 102, the enclosed aperture 314 defined by the bottom surface 312 of the third body shell portion 116, and the enclosed aperture 610 defined by the second body shell portion 112 may be axially aligned with one another about the longitudinal axis 900. Said differently, the opening 204 and apertures 314, 610 are disposed in an overlapping relationship with one another to cause effective translation of the applicator stem 700 within the body 102 and outwardly therefrom. In one embodiment, the second opening 204 may be selectively covered and sealed by the cover 104. In another embodiment, the second opening 204 may be defined partially or completely by a cap 206 selectively removably couplable to the third body shell portion 116.

More specifically, the third body shell portion 116 may also include a cap 206 operably configured to be selectively removably couplable to the second end 310 of the third body shell portion 116 in a watertight configuration. Like the plug 200, the cap 206 may include a portion 316 shaped and sized to be inserted within an enclosed aperture 318 defined by the second end 310 of the third body shell portion 116 in a watertight and substantially locked or retained configuration, e.g., using a frictionally engaged or tongue-and-groove configuration. The cap 206 may have the cover 104 selectively removably coupled thereto. The cover 104 may also be selectively retained and/or locked with respect to the cap 206 requiring a minimum level of force from the user to remove the cover 104 from the cap 206 (or the third body shell portion 116 if a cap is not utilized). The cap 206 beneficially the user to reuse the cap 206 and cover 104 with a replacement second body shell portion. In some embodiments, another plug may be utilized with the replacement second body shell portion, wherein said plug would be removed before use of the replacement second body shell portion.

With reference to FIG. 7 and FIGS. 10-11, the third body shell portion 116, or the cap 206, may include an internal sidewall surface 1004 disposed proximal to the second end 310 of the third body shell portion 116 and with a portion enclosing and tapering in diameter centrally to define an enclosed internal stem aperture 1006. The enclosed internal stem aperture 1006 may define a stem aperture diameter greater in length than a stem diameter 712 defined by a portion of the applicator stem 700 and less than an applicator diameter 714 defined by two opposing applicator surfaces. Said configuration may allow the stem 700 to pass freely through the enclosed internal stem aperture 1006 yet cause the applicator surface 706 to flex as a result of contacting the internal sidewall surface 1004 and cause excess cosmetic substance from passing through the enclosed internal stem aperture 1006. In some embodiments, the internal sidewall surface 1004 may include one or more portions coated with an abrasive surface or material to further facilitate in removing excess cosmetic substance. In further embodiments, the cap 206 may include a plug that engages with the internal sidewall surface 1004 encapsulate the cavity 304 in a watertight configuration. The cap 206, like other components may be of a substantially rigid, yet water-resistant material, e.g., low-density polyethylene and ABS plastic.

Although a specific order of using the cosmetic device 100 has been disclosed and depicted in the figures, the order of executing the steps may be changed relative to the order shown in certain embodiments. Also, two or more steps shown in succession may be executed concurrently or with partial concurrence in some embodiments. Certain steps may also be omitted for the sake of brevity. In some embodiments, some or all of the process steps can be combined into a single process.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A single-handed extendable cosmetic applicator comprising:

an applicator body including:

a selectively removable cover disposed at a second end, defining a second opening, of the applicator body that opposes a first end of the applicator body;

a first body shell portion having a sidewall surrounding and defining, with an inner surface of the first body shell portion, a first body shell cavity;

a second body shell portion rotatably coupled to the first body shell portion and having a first end, a second end opposing the first end of the second body shell portion, and a sidewall with a first portion disposed within the first shell cavity and a second portion having an outer surface and an inner surface opposing the outer surface of the second body shell portion and defining a second portion cavity, the second body shell portion defining an enclosed aperture spatially coupling the enclosed aperture to the first body shell cavity; and a third body shell portion having:

a sidewall surrounding and defining, with an inner surface of the third body shell portion, a third body shell cavity housing a liquid substance therein;

a bottom surface defining an enclosed aperture; and a first end and a second end opposing the first end of the third body shell portion, wherein the first end of the third body shell portion is selectively removably coupled to the second end of the second body shell portion with a tongue -and-groove configuration; and a cosmetic applicator stem having a lower end disposed in the first body shell cavity, an upper end opposing the lower end of the applicator stem, with a portion spanning through the enclosed aperture defined by the second body shell portion, with another portion coupled to the second body shell portion, and an applicator surface defined by a distal end of a plurality of bristles radially extending outwardly from an outer surface of the applicator stem, the second body shell portion operably configured to rotate about a longitudinal axis along a rotation path to cause linear and longitudinal translation of the cosmetic applicator stem through the second opening.

2. The single-handed extendable cosmetic applicator according to claim 1, wherein the third body shell portion further comprises:

a plug operably configured to be selectively removably couplable to the first end of the third body shell portion in a watertight configuration and with a portion shaped and sized to be inserted within the enclosed aperture of the third body shell portion.

3. The single-handed extendable cosmetic applicator according to claim 1, wherein:

the second opening defined by the second end of the applicator body, the enclosed aperture defined by the bottom surface of the third body shell portion, and the enclosed aperture defined by the second body shell portion are axially aligned with one another about the longitudinal axis.

4. The single-handed extendable cosmetic applicator according to claim 3, wherein the third body shell portion 116 further comprises:

a cap operably configured to be selectively removably couplable to the second end of the third body shell portion in a watertight configuration and with a portion shaped and sized to be inserted within an enclosed aperture defined by the second end of the third body shell portion, the cap having the cover selectively removably coupled thereto.

5. The single-handed extendable cosmetic applicator according to claim 4, wherein the third body shell portion further comprises:

an internal sidewall surface disposed proximal to the second end of the third body shell portion and with a portion enclosing and tapering in diameter centrally to define an enclosed internal stem aperture of a stem aperture diameter greater in length than a stem diameter defined by a portion of the applicator stem and less than an applicator diameter defined by two opposing applicator surfaces.

6. The single-handed extendable cosmetic applicator according to claim 1, wherein:

the applicator surface is selectively removably coupled and locked to the cosmetic applicator stem.

7. The single-handed extendable cosmetic applicator according to claim 1, wherein:

the applicator surface circumferentially spans around at least 50% a perimeter of the outer surface of the applicator stem.

8. The single-handed extendable cosmetic applicator according to claim 1, wherein the outer surface of the second body shell portion further comprises:

a plurality of raised surfaces spanning longitudinally thereon and each respectively defining a recess therein between.

9. The single-handed extendable cosmetic applicator according to claim 1, further comprising:

a double-helix shaped channel defined by the sidewall of the first body shell portion and spanning in a longitudinal direction;

two stem translation channels defined by the first portion of the sidewall disposed within the first shell cavity; and two applicator guide members projecting radially from the cosmetic applicator stem at least partially disposed, respectively, within the two stem translation channels and the double-helix shaped channel, wherein the rotation path is operably configured to cause rotation of the cosmetic applicator stem through the second opening the rotation of the two applicator guide members around the double-helix shaped channel.

10. The single-handed extendable cosmetic applicator according to claim 1, wherein:

the two applicator guide members oppose one another and the two stem translation channels oppose one another and having a linear and longitudinal oriented section flanked by and spatially coupled to two linear and transverse oriented sections.

11. A single-handed extendable cosmetic applicator comprising:

an applicator body including:

a selectively removable cover disposed at a second end, defining a second opening, of the applicator body that opposes a first end of the applicator body;

a first body shell portion having a sidewall surrounding and defining, with an inner surface of the first body shell portion, a first body shell cavity;

a second body shell portion rotatably coupled to the first body shell portion and having a first end, a second end opposing the first end of the second body shell portion, and a sidewall with a first portion disposed within the first shell cavity and a second portion having an outer surface and an inner surface opposing the outer surface of the second body shell portion and defining a second portion cavity, the second body shell portion defining an enclosed aperture spatially coupling the enclosed aperture to the first body shell cavity; and a third body shell portion having:

a sidewall surrounding and defining, with an inner surface of the third body shell portion, a third body shell cavity housing a liquid substance therein;

a bottom surface defining an enclosed aperture; and a first end and a second end opposing the first end of the third body shell portion, wherein the first end of the third body shell portion is selectively removably coupled to the second end of the second body shell portion with a tongue-and-groove configuration; and a cosmetic applicator stem having a lower end disposed in the first body shell cavity, an upper end opposing the lower end of the applicator stem, with a portion spanning through the enclosed aperture defined by the second body shell portion, with another portion coupled to the second body shell portion, and an applicator surface defined by the applicator stem, the second body shell portion operably configured to rotate about a longitudinal axis along a rotation path to cause linear and longitudinal translation of the cosmetic applicator stem through the second opening.

12. The single-handed extendable cosmetic applicator according to claim 11, wherein:

the applicator surface is defined by a distal end of a plurality of bristles radially extending outwardly from an outer surface of the applicator stem.

13. The single-handed extendable cosmetic applicator according to claim 12, wherein the third body shell portion further comprises:

a plug operably configured to be selectively removably couplable to the first end of the third body shell portion in a watertight configuration and with a portion shaped and sized to be inserted within the enclosed aperture of the third body shell portion.

14. The single-handed extendable cosmetic applicator according to claim 13, wherein:

the second opening defined by the second end of the applicator body, the enclosed aperture defined by the bottom surface of the third body shell portion, and the enclosed aperture defined by the second body shell portion are axially aligned with one another about the longitudinal axis.

15. The single-handed extendable cosmetic applicator according to claim 14, wherein the third body shell portion further comprises:

a cap operably configured to be selectively removably couplable to the second end of the third body shell portion in a watertight configuration and with a portion shaped and sized to be inserted within an enclosed aperture defined by the second end of the third body shell portion, the cap having the cover selectively removably coupled thereto.

16. The single-handed extendable cosmetic applicator according to claim 11, further comprising:

a double-helix shaped channel defined by the sidewall of the first body shell portion and spanning in a longitudinal direction;

two stem translation channels defined by the first portion of the sidewall disposed within the first shell cavity; and two applicator guide members projecting radially from the cosmetic applicator stem at least partially disposed, respectively, within the two stem translation channels and the double-helix shaped channel, wherein the rotation path is operably configured to cause rotation of the cosmetic applicator stem through the second opening the rotation of the two applicator guide members around the double-helix shaped channel.

17. The single-handed extendable cosmetic applicator according to claim 11, wherein:

the two applicator guide members oppose one another and the two stem translation channels oppose one another and having a linear and longitudinal oriented section flanked by and spatially coupled to two linear and transverse oriented sections.

* * * * *